US011178970B1

(12) United States Patent
Crum

(10) Patent No.: US 11,178,970 B1
(45) Date of Patent: Nov. 23, 2021

(54) HIGH-LEG HIDDEN OTTOMAN RECLINER SEATING MECHANISM

(71) Applicant: L&PPROPERTY MANAGEMENT COMPANY, South Gate, CA (US)

(72) Inventor: Michael Andrew Crum, Mantachie, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 16/948,708

(22) Filed: Sep. 29, 2020

(51) Int. Cl.
*A47C 1/0355* (2013.01)

(52) U.S. Cl.
CPC ..... *A47C 1/0355* (2013.01)

(58) Field of Classification Search
CPC . A47C 1/0355; A47C 1/03211; A47C 1/0345; A47C 1/0342; A47C 1/0242; A47C 1/032; A47C 1/024; A47C 1/034
See application file for complete search history.

(56) References Cited

U.S. PATENT DOCUMENTS 9,326,606 B2 * 5/2016 LaPointe ..... A47C 1/0355
9,700,140 B2 * 7/2017 Lawson ..... A47C 1/0345
10,021,980 B2 * 7/2018 Lawson ..... A47C 1/0355
10,118,508 B2 * 11/2018 Bowen ..... A47C 1/0345
10,507,742 B2 * 12/2019 Bowen ..... A47C 1/0345
10,842,274 B1 * 11/2020 Crawford ..... A47C 1/0345
2010/0127538 A1 * 5/2010 Hoffman ..... A47C 3/18 297/68
2010/0127556 A1 * 5/2010 Hoffman ..... A47C 3/0255 297/85 R
2012/0049606 A1 * 3/2012 Lawson ..... A47C 1/0355 297/85 M
2014/0327282 A1 * 11/2014 Crum ..... A47C 1/032 297/259.2
2015/0054315 A1 * 2/2015 Donovan ..... A47C 1/0345 297/68
2015/0054316 A1 * 2/2015 Donovan ..... A47C 1/0342 297/76
2015/0076881 A1 * 3/2015 LaPointe ..... A47C 1/032 297/316
2015/0076883 A1 * 3/2015 LaPointe ..... A47C 1/0242 297/354.1
2015/0282619 A1 * 10/2015 Lawson ..... A47C 1/0355 297/83
2015/0289655 A1 * 10/2015 Lawson ..... A47C 1/0342 297/75

(Continued)

*Primary Examiner* — Shin H Kim
(74) *Attorney, Agent, or Firm* — Shook Hardy & Bacon L.L.P.

(57) ABSTRACT

A seating unit is provided that is moveable between closed, extended and fully reclined positions. The seating unit comprises two sides spaced from one another and a seat extending between the two sides, an extendable ottoman and a chair back extending upwardly from a rearward edge of the seat. The seating unit further comprises a side plate adjacent each of the two sides and at least one support tube extending between the side plates. The seating unit has a linkage mechanism supported on the side plates and coupling at least the ottoman and the chair back. A motor is coupled to the linkage mechanism to move the seating unit between the closed, extended and fully reclined positions, wherein the motor extends above the at least one support tube.

7 Claims, 11 Drawing Sheets

(56) References Cited

U.S. PATENT DOCUMENTS

| | | | | |
|---|---|---|---|---|
| 2016/0022040 | A1* | 1/2016 | Lawson | A47C 1/0355<br>297/68 |
| 2016/0029800 | A1* | 2/2016 | Bryant | A47C 1/0242<br>297/284.3 |
| 2016/0045031 | A1* | 2/2016 | Lawson | A47C 1/0355<br>297/284.3 |
| 2016/0058191 | A1* | 3/2016 | Hegedus | A47C 1/0342<br>297/330 |
| 2016/0088942 | A1* | 3/2016 | Murphy | A47C 1/0242<br>297/311 |
| 2016/0100687 | A1* | 4/2016 | Murphy | A47C 7/503<br>297/271.3 |
| 2016/0273632 | A1* | 9/2016 | Lawson | A47C 1/0355 |
| 2018/0027967 | A1* | 2/2018 | Lawson | A47C 1/0352 |
| 2018/0242740 | A1* | 8/2018 | Lawson | A47C 1/0345 |
| 2019/0061569 | A1* | 2/2019 | Bowen | B60N 2/2252 |
| 2019/0082843 | A1* | 3/2019 | LaPointe | A47C 1/03255 |
| 2019/0216221 | A1* | 7/2019 | Bryant | A47C 1/0347 |
| 2020/0113333 | A1* | 4/2020 | Crum | A47C 1/0355 |
| 2020/0352334 | A1* | 11/2020 | Browning | A47C 7/506 |

* cited by examiner

HIGH-LEG HIDDEN OTTOMAN RECLINER SEATING MECHANISM

TECHNICAL FIELD

Embodiments of the present invention relate to recliner seating mechanisms and chairs using them, and particularly to a powered recliner seating mechanism for use on a chair with a high-leg design, and an ottoman and motor that are hidden from view when in a stored position.

BACKGROUND OF THE INVENTION

One design of chairs using a reclining mechanism is known as a high-leg design. In these types of chairs, the legs suspend the seat above a flooring surface such that one can see under the chair. In a chair having this styling, the ottoman is stored in a more-horizontal position (as opposed to a vertical position). To this point in time, it has been difficult to provide a motorized mechanism to extend the ottoman and recline a chair having this styling. One problem of providing a powered reclining mechanism used with chairs of this styling is the positioning of the motor. In order to preserve the appearance of the high-leg chair, the motor providing power to the mechanism should be out of sight, or at least inconspicuous and mostly out of sight. The motor must be positioned and coupled to the remainder of the linkage mechanism to move the ottoman from a closed position, about sixty-seven degrees past perpendicular (to the floor), through a perpendicular position, and into an extended position that is substantially parallel to the floor. The motor must therefore be positioned high enough as to be relatively unseen, but also fit within the remainder of the mechanism and not interfere with any links or any part of the seating unit, such as the seat springs supporting the seat.

BRIEF DESCRIPTION OF THE INVENTION

A seating unit is provided that is moveable between closed, extended and fully reclined positions. The seating unit comprises two sides spaced from one another and a seat extending between the two sides, an extendable ottoman and a chair back extending upwardly from a rearward edge of the seat. The seating unit further comprises a side plate adjacent each of the two sides and at least one support tube extending between the side plates. The seating unit has a linkage mechanism supported on the side plates and coupling at least the ottoman and the chair back. A motor is coupled to the linkage mechanism to move the seating unit between the closed, extended and fully reclined positions, wherein the motor extends above the at least one support tube. In some aspects, the sides of the chair have a bottom edge spaced from a support surface on which the seating unit rests in use, wherein the sides of the chair substantially obscure the linkage mechanism and the motor from view.

In some aspects, in the extended position, the linkage mechanism holds the ottoman substantially parallel to the support surface on which the seating unit rests, and as the motor moves the linkage mechanism from the extended to the closed position, the linkage mechanism moves the ottoman through a position perpendicular to the support surface on which the seating unit rests to a position at least about forty-five degrees past perpendicular to the support surface on which the seating unit rests, or at least about fifty-five degrees past perpendicular to the support surface on which the seating unit rests, or at least about sixty-seven degrees past perpendicular to the support surface on which the seating unit rests.

In some aspects, the seat comprises a padded portion supported on a resilient support surface of the seating unit, and the resilient support surface has a location of maximum deformation, and at the point of maximum deformation, the motor is spaced from the resilient support surface by at least one-and-a-half inches, or by at least two inches, or by at least two-and-a-half inches.

In some aspects, the at least one support tube includes a downwardly extending central section that provides clearance for the motor above the at least one support tube.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Embodiments of the present invention generally relate to a seating unit having a motorized mechanism usable on a high-leg styled chair that is inconspicuous and that moves the ottoman from a closed position to an extended position, and can recline the back of the seating unit with the ottoman extended.

An exemplary seating mechanism 10 is shown in a cross-section of a seating unit 12 in a closed position in FIG.

Figure 1:
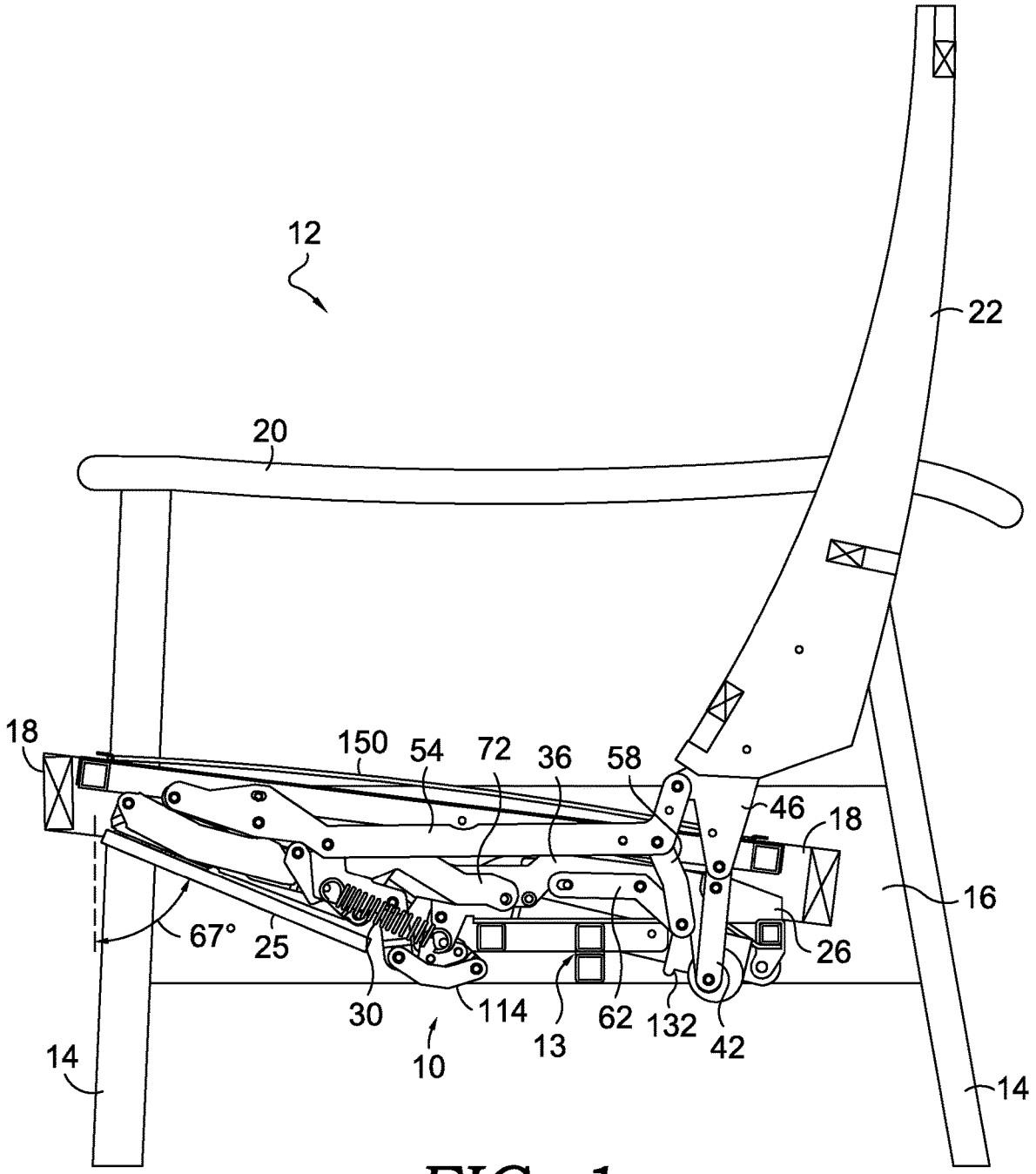
FIG. 1 is a cross sectional view of an exemplary chair with a mechanism in a closed position, showing one side of a mechanism, in accordance with an embodiment of the invention.
Figure 2:
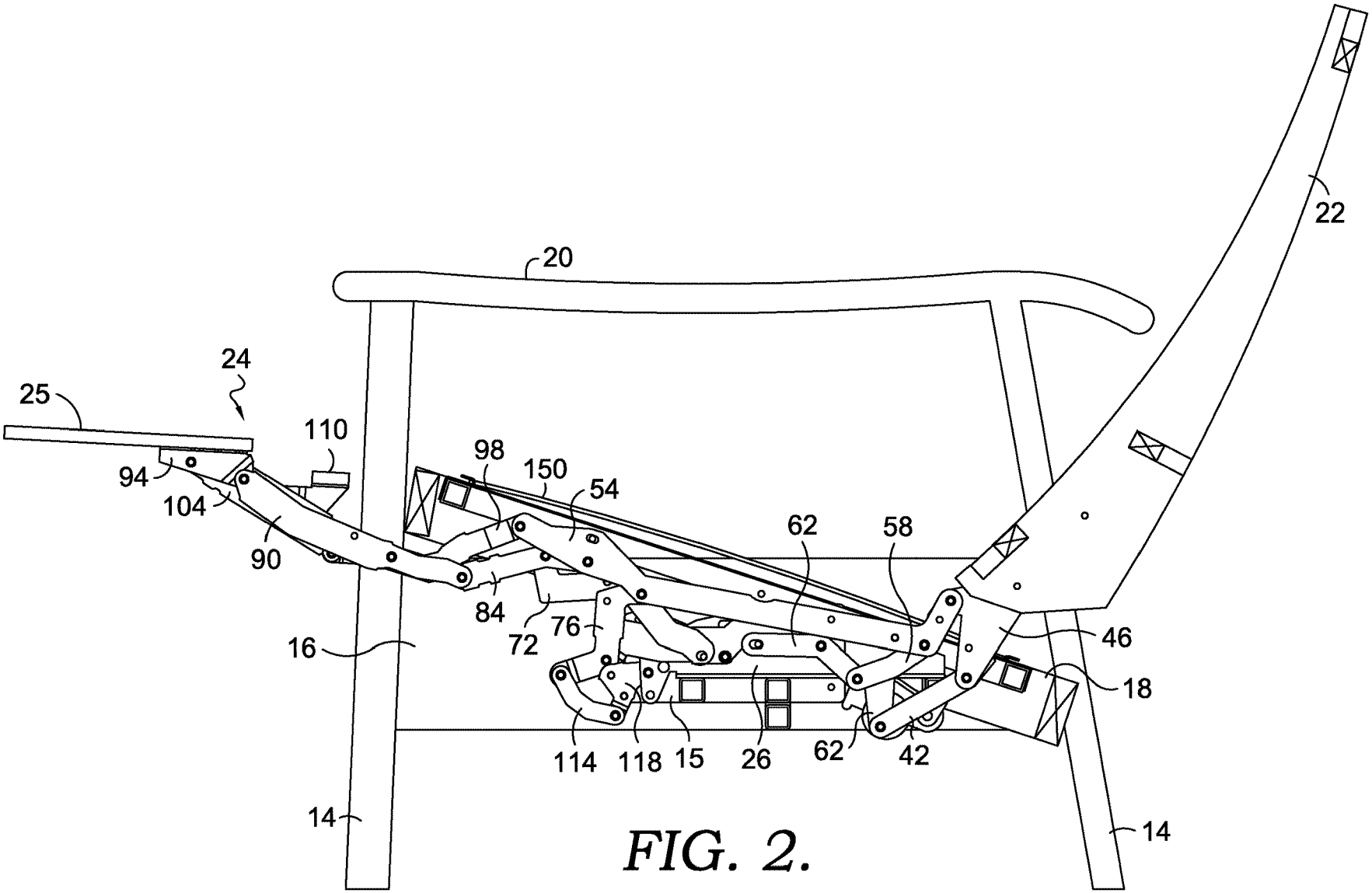
FIG. 2 is a view similar to FIG. 1, but showing the chair in the TV or extended position.

1. The seating unit 12, in some aspects, has legs 14, a side frame 16 that cooperates with the mechanism 10 to support a seat 18 above the floor or other support surface. The seating unit 12 also has arms 20 that, in some embodiments are integrally formed with the legs 14. The mechanism 10 allows the seating unit 12 to use what is known as "high-leg" styling, while at the same time allowing the seating unit 12 to have a motor positioned to move the seating unit 12 between the closed position of FIG. 1, to the extended (or TV) position of FIG. 2, and to the fully reclined position of FIG. 3. In the extended position of FIG. 2, a back 22 remains in a generally upright position, but a footrest assembly 24 moves a footrest 25 from a stowed position as shown in FIG. 1 to an extended position as shown in FIG. 2. The seat 18 moves rearward and the seat 18 inclines from the back of the seat 18 to the front of the seat 18 in the extended position of FIG. 2. In the fully reclined position of FIG. 3, the back 22 reclines relative to the seat 18, the footrest assembly 24 remains extended, and the seat 18 moves farther rearward, with the angle of incline for seat 18 increasing.

Figure 6:
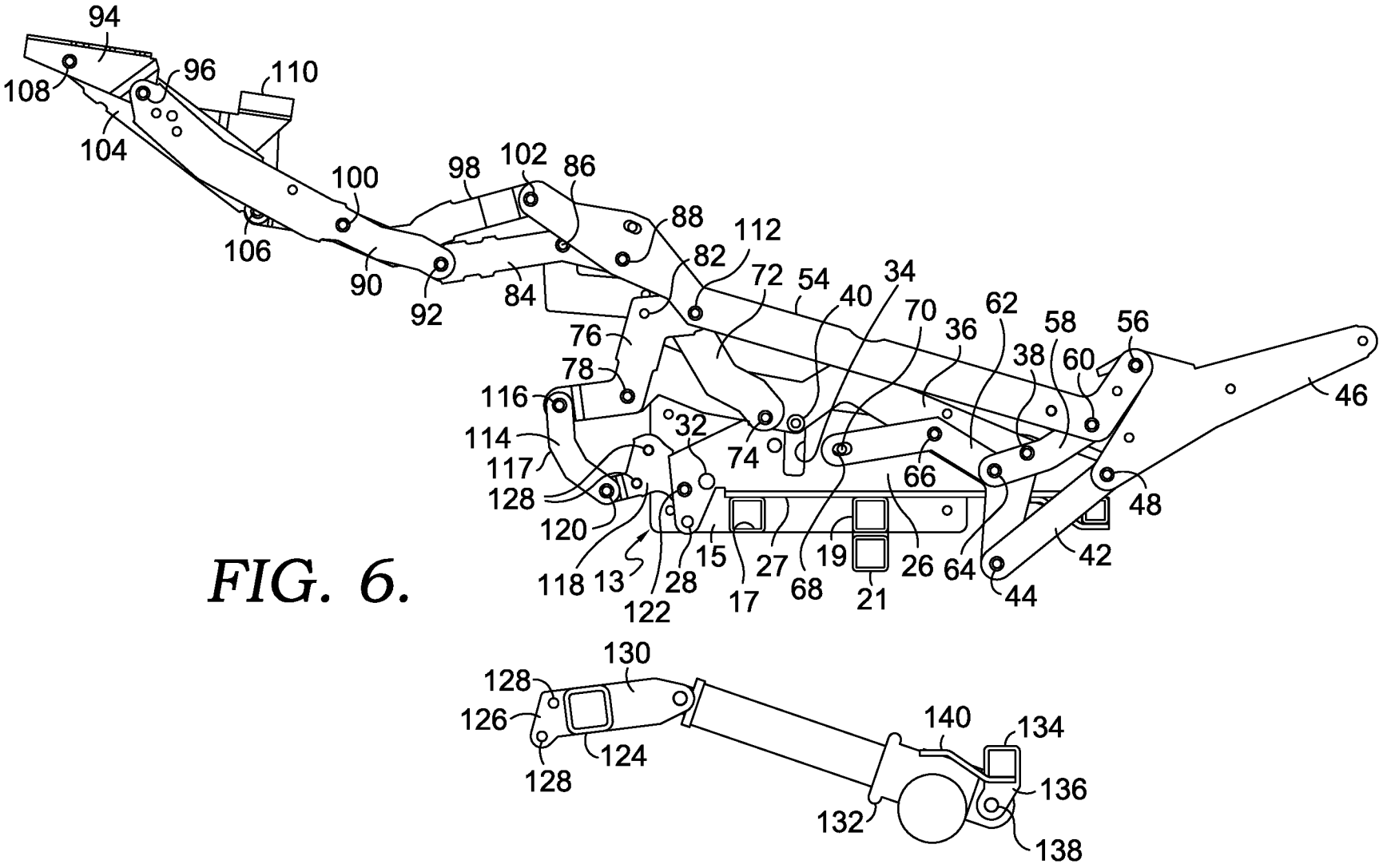
FIG. 6 is a view of the mechanism of FIG. 3 in the fully reclined position, showing selected components broken out.

For simplicity, the mechanism 10 is shown in FIGS. 4A-C through FIG. 6 without the remainder of seating unit 12. The mechanism 10 is coupled to the seating unit 12 via an arm chassis 13, as best seen in FIG. 6. The arm chassis 13 includes a side plate 15 that is fixedly coupled to a corresponding side frame 16. A front support tube 17 and a rear support tube 19 are fixedly coupled between opposing side plates 15, such that the front support tube 17 and rear support tube 19 extend from one side of the seating unit 12 to the other. In some aspects, the front support tube 17 is straight, from one end to the other. In some aspects, the rear support tube 19 includes a downward, central bend section 21 to provide clearance for other components, as described below.

Figure 4:
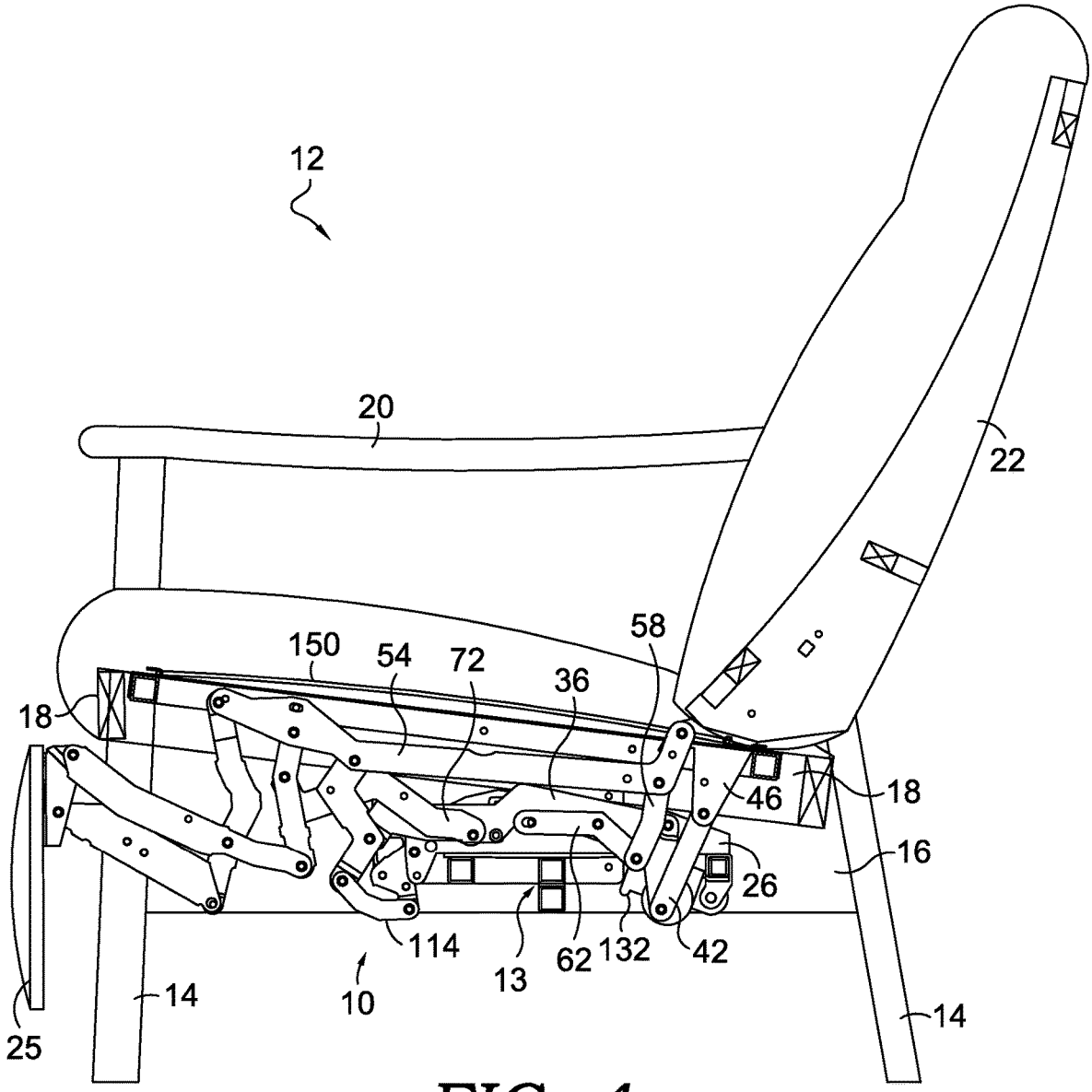
FIG. 4 is a view of the similar to FIG. 1, but showing the chair transitioning from the closed position to the TV position.
Figure 4A:
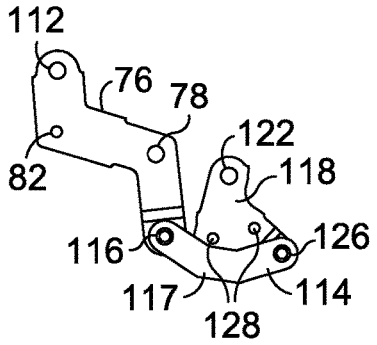
FIG. 4A is a view of selected components of the mechanism in the position of FIG. 1.
Figure 4B:
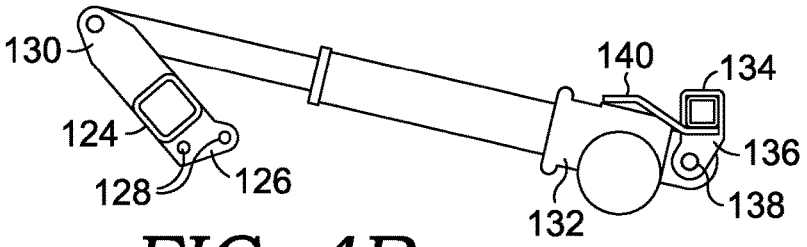
FIG. 4B is a view of selected components of the mechanism in the position of FIG. 1.
Figure 4C:
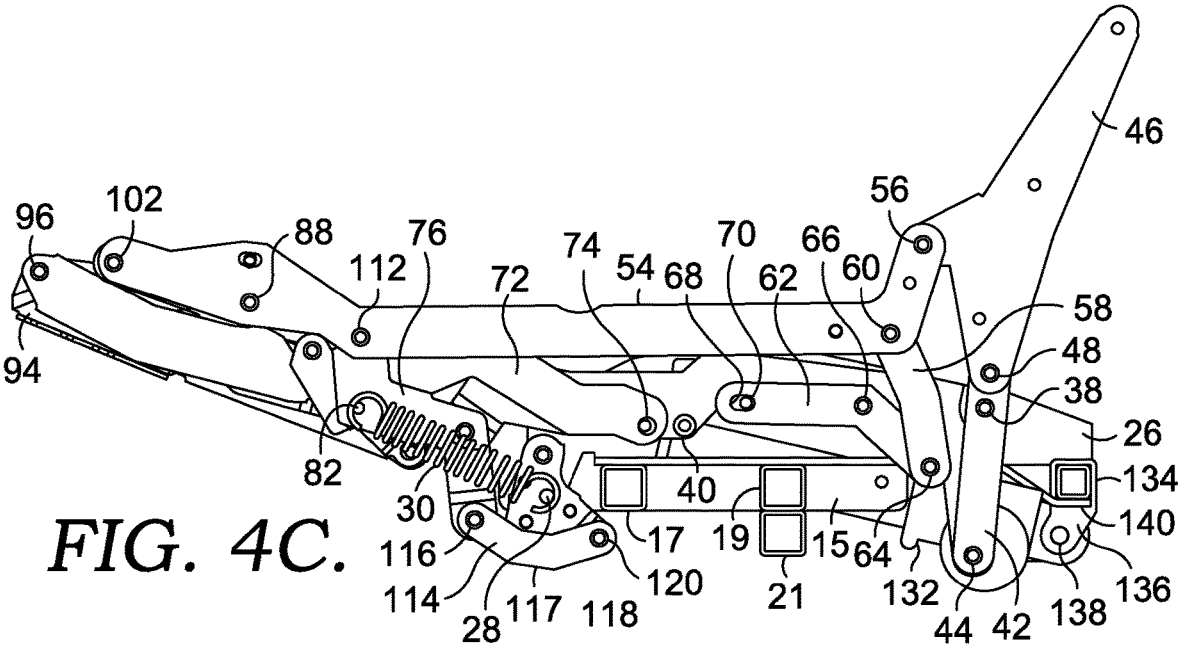
FIG. 4C is a view of selected components of the mechanism in the position of FIG. 1.

A chassis link 26 is fixedly coupled to the arm chassis 13, such as by bolting a flange 27 on the chassis link 26 to the front support tube 17 and the rear support tube 19. The front, lower end of the chassis link 26 has a spring connection point 28. The spring connection point 28 could simply be a hole in chassis link 26 or could also be a pin on which to secure a spring 30, as shown in FIG. 4C. The spring 30 biases the mechanism 10 to the closed position shown in FIG. 1. The spring 30 is only shown in some of the figures, so as not to obscure other links. The chassis link 26 also has an elongated slot 34 formed therein, the function of which is described further below. Forward of the slot 34, a pin 32 is fixedly coupled to chassis link 26 and extends outwardly therefrom. The pin 32 supports other components of the mechanism 10 when in the closed position.

A recline tilt link 36 is pivotally coupled to a second end of chassis link 26 at pivot point 38. The pivot point 38 is shown in the figures in solid lines for context, even though other links would hide it from view. The recline tilt link 36 is shaped as best seen in FIG. 6. The pivotal movement of recline tilt link 36 relative to the chassis link 26 is controlled and constrained by a rivet 40 (or other connector) that couples the recline tilt link 36 to the chassis link 26 at the slot 34. The rivet 40 allows the recline tilt link 36 to rotate about pivot point 38 from a lower position, with the rivet 40 at the bottom of the slot 34 when the mechanism 10 is in the closed and extended positions, to a raised position when the mechanism 10 is in a fully reclined position (FIG. 6) and the rivet 40 is at the top of the slot 34. In the lower position, the recline tilt link 36 is also supported by the pin 32 on the chassis link 26.

Figure 5:
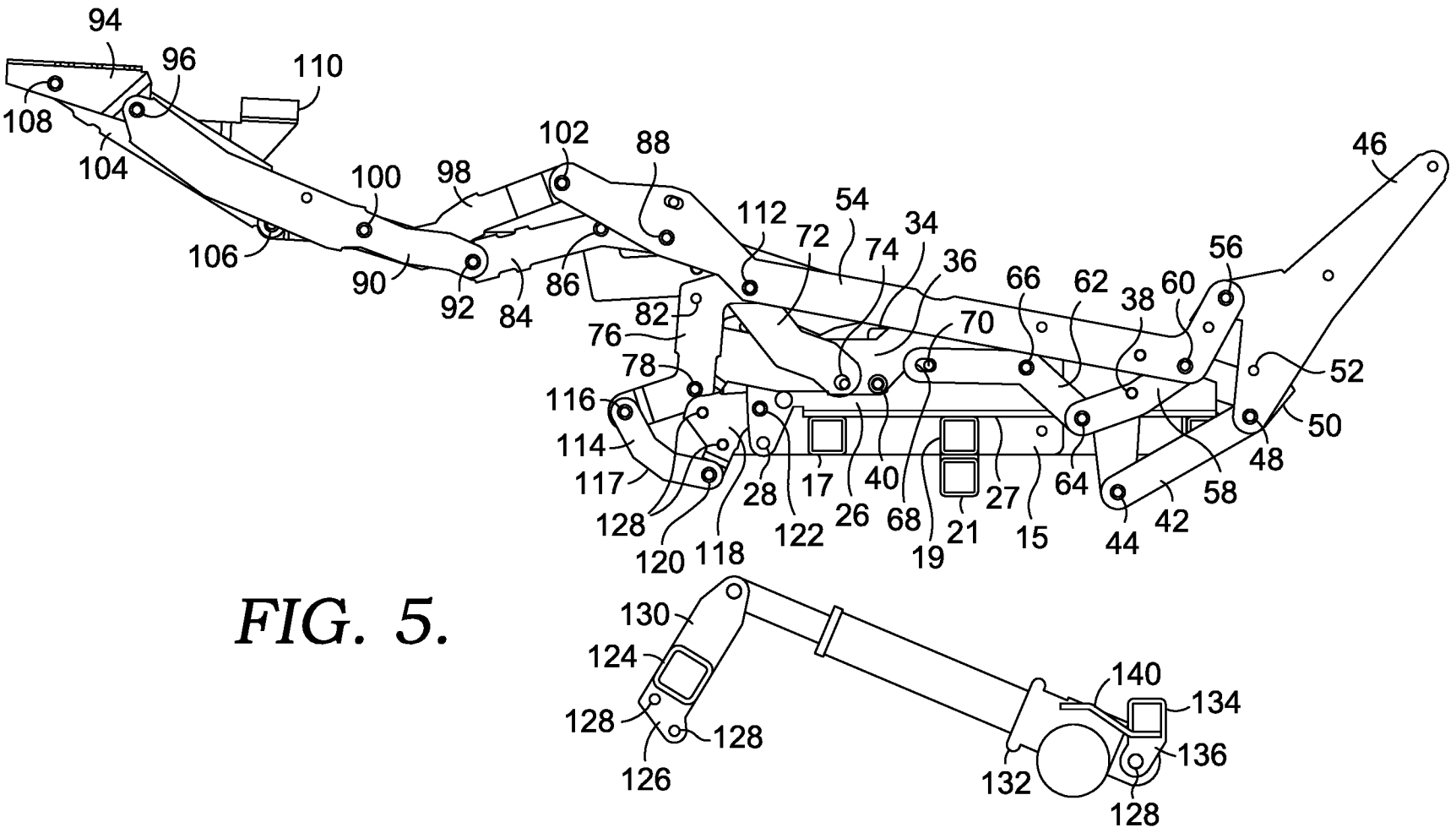
FIG. 5 is a view of the mechanism of FIG. 2 in the TV position, showing selected components broken out.

Below pivot point 38, a back pivot link 42 is pivotally coupled to the recline tilt link 36 at pivot point 44. The back pivot link 42 extends upwardly from pivot point 44 and is pivotally coupled on its other end to a back link 46 at pivot point 48. The back pivot link 42 has a retaining finger 50 that extends upwardly beyond pivot point 48 as partially seen in FIG. 5. The retaining finger 50 engages a stop stud 52, that is fixedly coupled to the back link 46 and that extends from the back link 46, both when mechanism is in the closed position of FIG. 4 and the fully reclined position of FIG. 6 to provide added stability. The back link 46 has a generally triangular shape and is used to couple the back 22 to the mechanism 10 as would be known to those of skill in the art.

A seat link 54 is pivotally coupled to a forward, lower end of the back link 46 at pivot point 56. The seat link 54 carries and supports seat 18. Below pivot point 56, a rear pivot link 58 is pivotally coupled to the seat link 54 at pivot point 60. The rear pivot link 58 extends away from pivot point 60 with a slight bend in the middle, and is pivotally coupled to a recline pivot link 62 at pivot point 64. The recline pivot link 62 is also pivotally coupled to the recline tilt link 36 near the midpoint of the recline pivot link 62 at pivot point 66. At this midpoint, the recline pivot link 62 has a slight bend. The end of recline pivot link 62 opposite pivot point 64 has a slot 68 that is used to couple recline pivot link 62 to chassis link 26 with a rivet 70. The slotted connection provided by slot 68 and rivet 70 allows recline pivot link 62 to pivot about pivot point 66 as can best be seen by comparing FIG. 4 and FIG. 6.

Near the rivet 40, a footrest drive link 72 is pivotally coupled on one end to the recline tilt link 36 at pivot point 74. Staying with recline tilt link 36, a front pivot link 76 is pivotally coupled to the forward end of recline tilt link 36 at pivot point 78. The upper end of the front pivot link 76 has a spring connection 82. As with spring connection 28, the spring connection 82 can simply be a hole in the front pivot link 76 or could be a stud extending from the front pivot link 76. As best seen in FIG. 4C, the spring 30 is coupled to and between the front pivot link 76 and the chassis link 26 at the spring connection 82 and the spring connection 28, respectively, to bias the mechanism 10 to the closed position.

The end of footrest drive link 72 opposite pivot point 74 is pivotally coupled to a lower ottoman link 84 generally midway along lower ottoman link 84 at pivot point 86. Footrest drive link 72 is shaped as best seen in FIG. 6 and is pivotally coupled to recline tilt link 36 and lower ottoman link 84. The upper end of lower ottoman link 84 is pivotally coupled to seat link 54 at pivot point 88. The lower end of lower ottoman link 84 is pivotally coupled to a main ottoman link 90 at a pivot point 92. The end of main ottoman link 90 opposite pivot point 92 is pivotally coupled to a footrest bracket 94 at pivot point 96. An upper ottoman link 98 of footrest assembly 24 is pivotally coupled to main ottoman link 90 at pivot point 100. A first end 102 of upper ottoman link 98 is pivotally coupled to seat link 54 at pivot point 102. Footrest assembly 24 also includes a secondary ottoman link 104 that is pivotally coupled to upper ottoman link 98 at pivot point 106. The end of secondary ottoman link 104 opposite pivot point 106 is pivotally coupled to footrest bracket 94 at pivot point 108. In some aspects, a mid-ottoman bracket 110 is also pivotally coupled through a linkage to secondary ottoman link 104.

As best seen in FIG. 6, the top of the front pivot link 76 is pivotally coupled to the seat link 54 at pivot point 112. The bottom of the front pivot link 76 is pivotally coupled to a drive link 114 at pivot point 116. The other end of drive link 114 is pivotally coupled to a connector link 118 at pivot point 120. As the drive link 114 extends from pivot point 116 to pivot point 120, it has a central flat section 117. In the closed position, the pivot point 116 and the pivot point 120 are above the bottom of the central flat section 117. The connector link 118 is also pivotally coupled to the chassis link 26 at pivot point 122, as best seen in FIG. 6. The connector link 118 is fixedly coupled to a front motor tube 124 via end brackets 126, such as by placing bolts or other connectors through holes 128. The front motor tube 124 extends between opposing brackets 126. Generally midway along the front motor tube 124, a clevis 130 is used to pivotally couple the front motor tube 124 to the shaft of a motor 132. The rear of motor 132 is pivotally coupled to a rear motor tube 134 via a clevis 136 at pivot point 138. Each end of the rear motor tube 134 is coupled to a respective chassis link 26, as best seen in FIG. 4C. In some aspects, a torque link 140 is fixedly coupled between the rear motor tube 134 and the chassis link 26 as a reinforcement. In FIGS. 4A, 4B, 5 and 6, certain components of connection of motor 132 to the remainder of mechanism 10 are shown broken out below the remainder of the figure to more clearly show the orientation and movement of these components.

Figure 7:
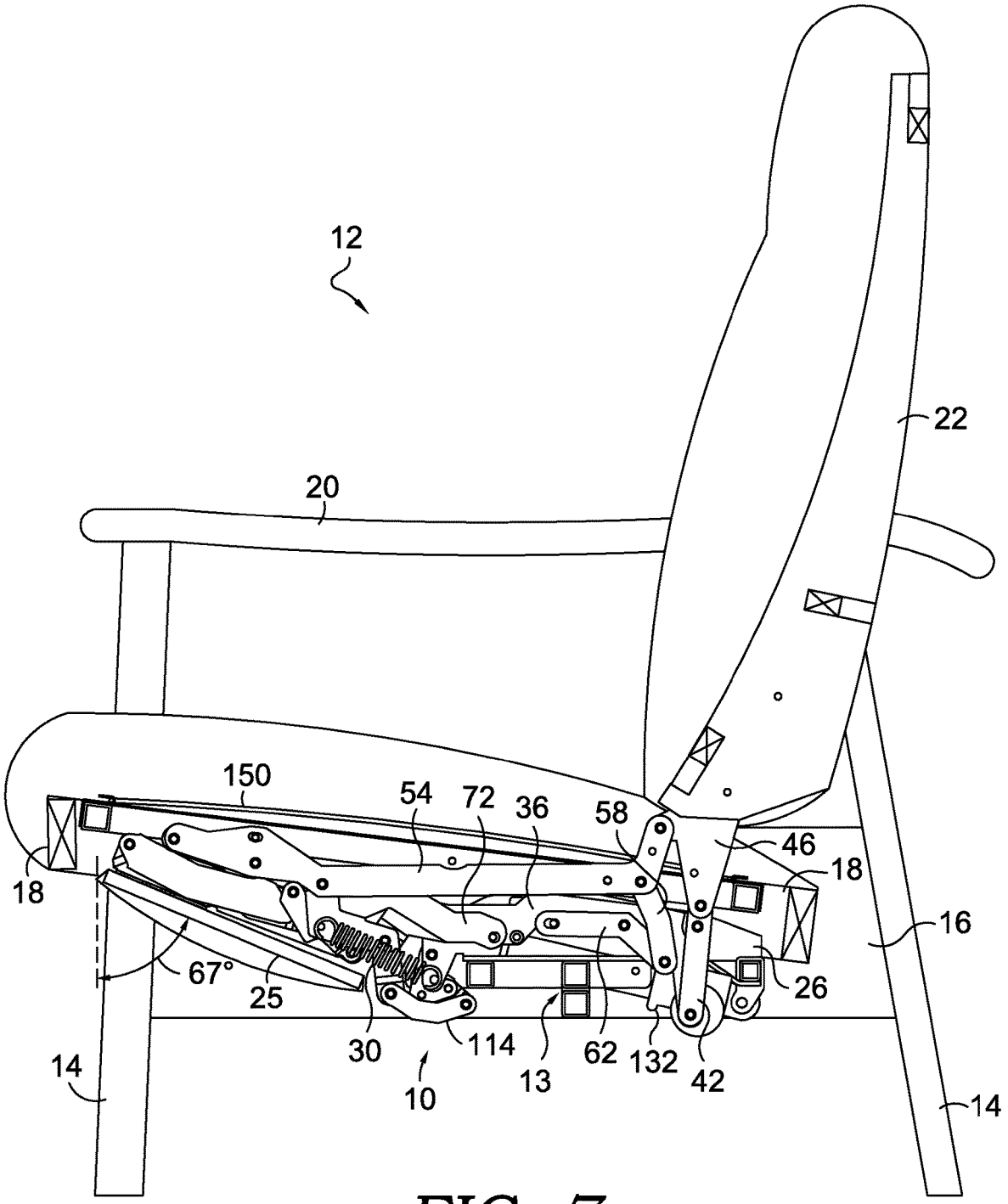
FIG. 7 is a view similar to FIG. 1, showing additional finishing upholstery.

To transition the mechanism 10, and seating unit 12 from the closed position of FIG. 1 to the extended position of FIG. 2, a user will activate motor 132, to retract the shaft of the motor 132. This force pulls rearwardly on the clevis 130 and rotates front motor tube 124. Due to the fixed connection of front motor tube 124 and connector link 118, rotation of the front motor tube 124 also rotates connector link 118 about pivot point 122. As connector link 118 rotates, it moves drive link 114, and thus also rotates front pivot link 76 about pivot point 78 and pivot point 112. This rotation drives seat link 54 up and rearward. As seat link 54 moves up and rearward, the footrest drive link 72 moves the footrest assembly 24 to the extended position of FIG. 2. Additionally, as the seat link 54 moves up and rearwardly, the rear pivot link 58 and the back pivot link 42 act on the back link 46 to rotate it into a slightly reclined position. In the closed position, the footrest 25 is angled relative to the floor. In some aspects, this angle is at least forty-five degrees past perpendicular. In other aspects, this angle is at least fifty-five degrees past perpendicular. In still other aspects, this angle is at least sixty-seven degrees past perpendicular, as shown in FIGS. 1 and 7. In moving to the TV position, the footrest 25 moves through a position perpendicular to the floor (as shown in FIG. 4) and out to a position generally parallel to the floor in the TV position. With the footrest 25 in the closed, angled position, the footrest 25 is hidden from view.

Figure 8:
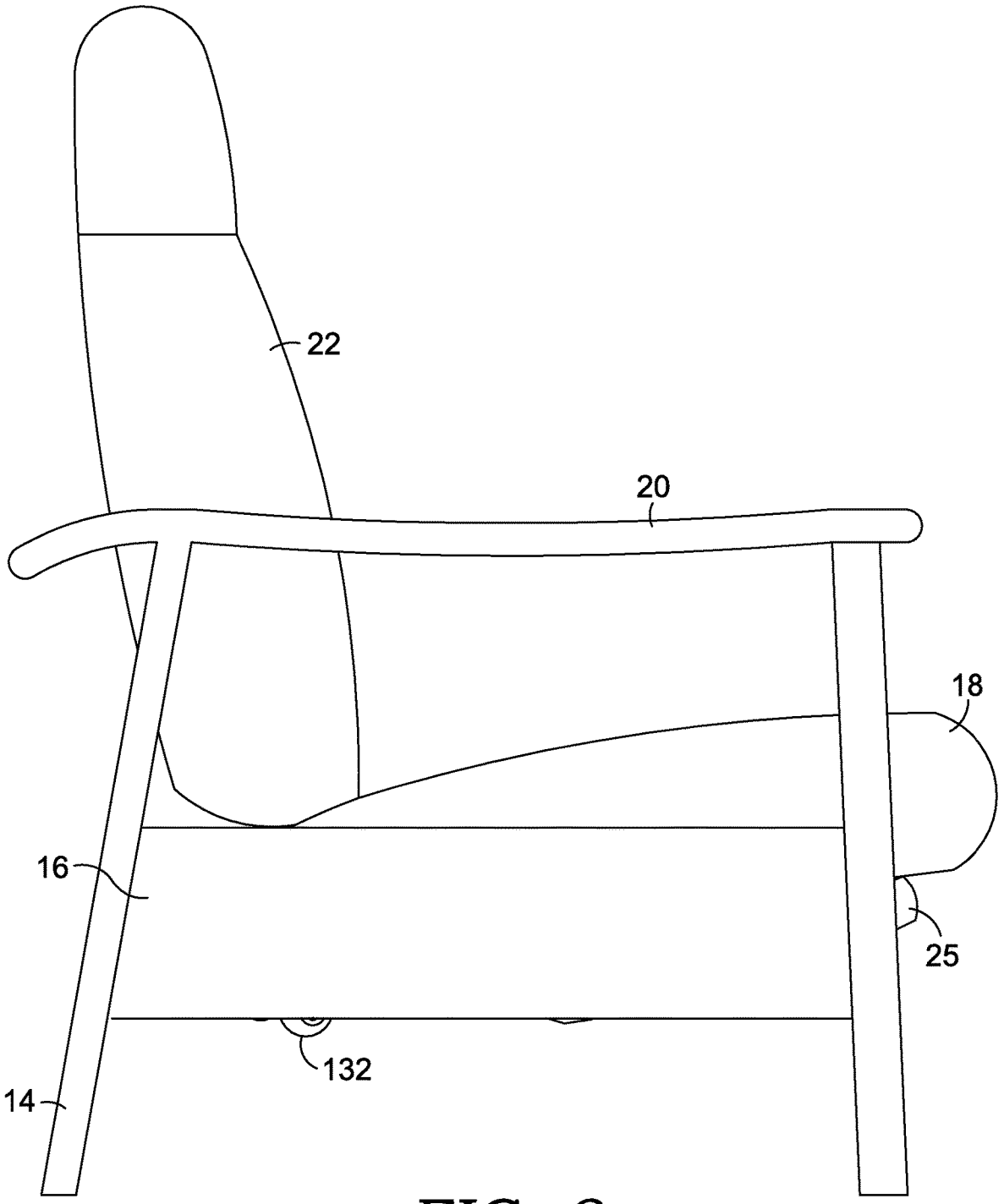
FIG. 8 is a side view of the chair of FIG. 7.
Figure 9:
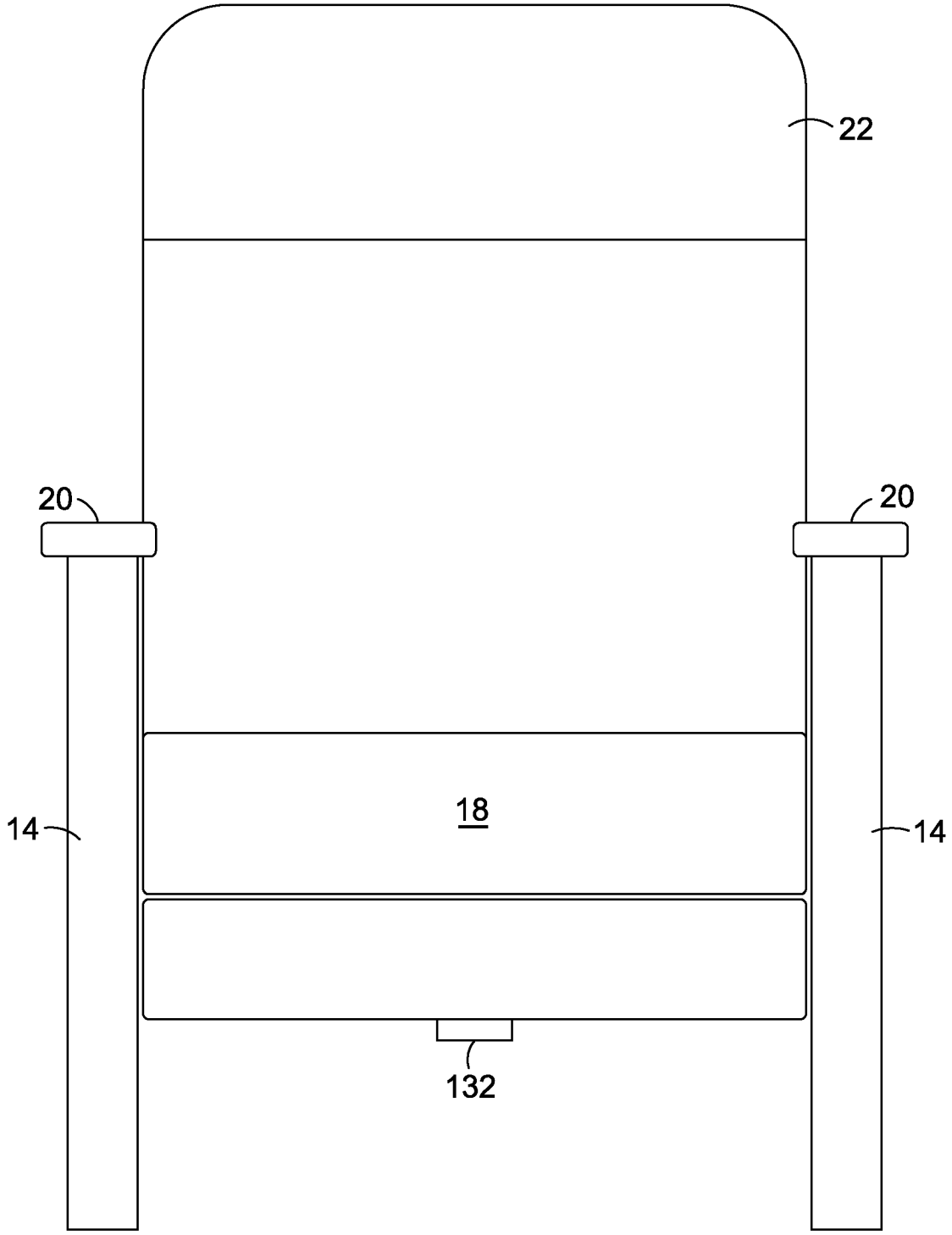
FIG. 9 is a front view of the chair of FIG. 7.
Figure 10:
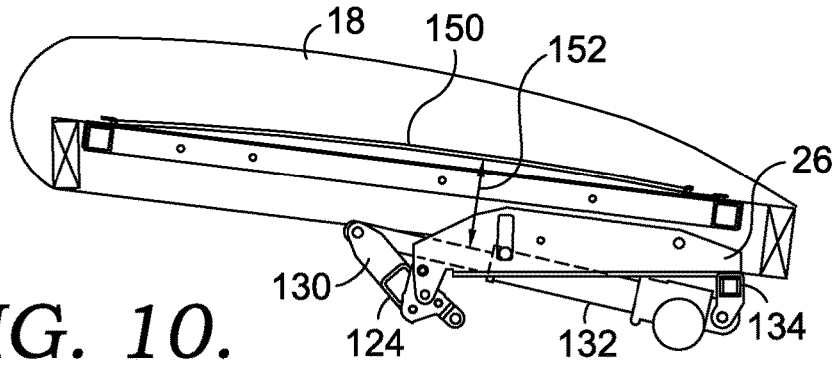
FIG. 10 is a view of selected components in the closed position shown in FIG. 1.
Figure 11:
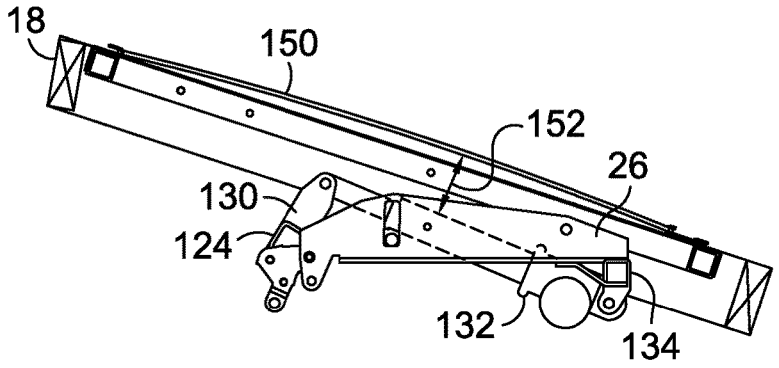
FIG. 11 is a view of selected components in the TV position of FIG. 2.
Figure 12:
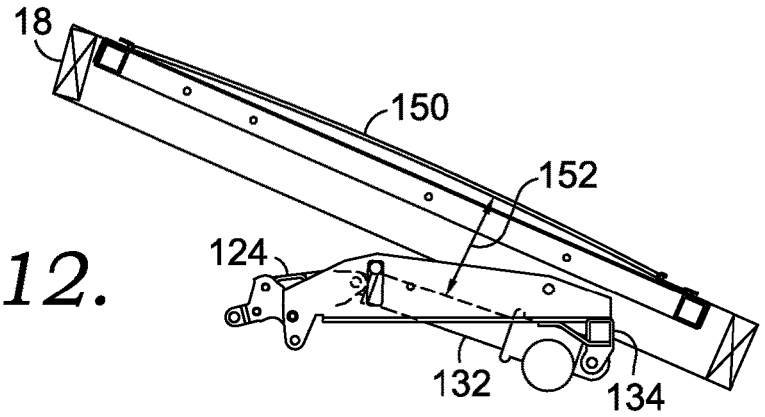
FIG. 12 is a view of selected components in the fully reclined position of FIG. 3.

Additionally, as best seen in FIGS. 10-12, the motor 132 is mounted to the rear motor tube 134 and front motor tube 124 in an angled position, such that the rear of motor 132 is lower that the front clevis 130 mounting the shaft of the motor 132 to the front motor tube 124. In this angled position, the motor 132 is positioned above center bend 21 of the rear support tube. Also, due to this unique mounting, the motor 132 and the mechanism 10 are substantially obscured or hidden from view, as may be desirable to at least some users. As used herein, the term "substantially," when used herein to describe the portion of the motor seen includes a range of 80% to 100%. For example, the motor 132 is substantially obscured from view when at least about 80% of the motor is obscured from view. In other aspects, far greater than 80% of the motor is obscured from view, as can be seen in FIGS. 8 and 9. The front pivot link 76, the drive link 114 and the connector link 118 form a compact linkage between the motor 132 and the remainder of the mechanism 10, allowing the motor 132 to provide a motorized opening and closing of the mechanism, while remaining substantially hidden from view. Because the connector link 118 has a bend at the central section 117, the connector link 118 is hidden from view when in the closed position of FIG. 1. While the motor 132 is mounted high enough to keep it hidden from view, the motor 132 is also mounted low enough to provide clearance for the seat 18. More specifically, as shown in FIGS. 10-12, the motor 132 fits well below support springs 150 that provide cushioning and support for the remainder of the seat 18. In some aspects, a point of maximum deformation of springs 150 can be determined, such as at the point delineated by dimension 152. At this point of maximum deformation 152, in some aspects, the motor 132 has a clearance of at least one-and-a-half inches in each position of the chair 12, or a clearance of at least two inches in each position of the chair 12 or a clearance of at least two-and-a-half inches in each position of the chair 12.

Figure 3:
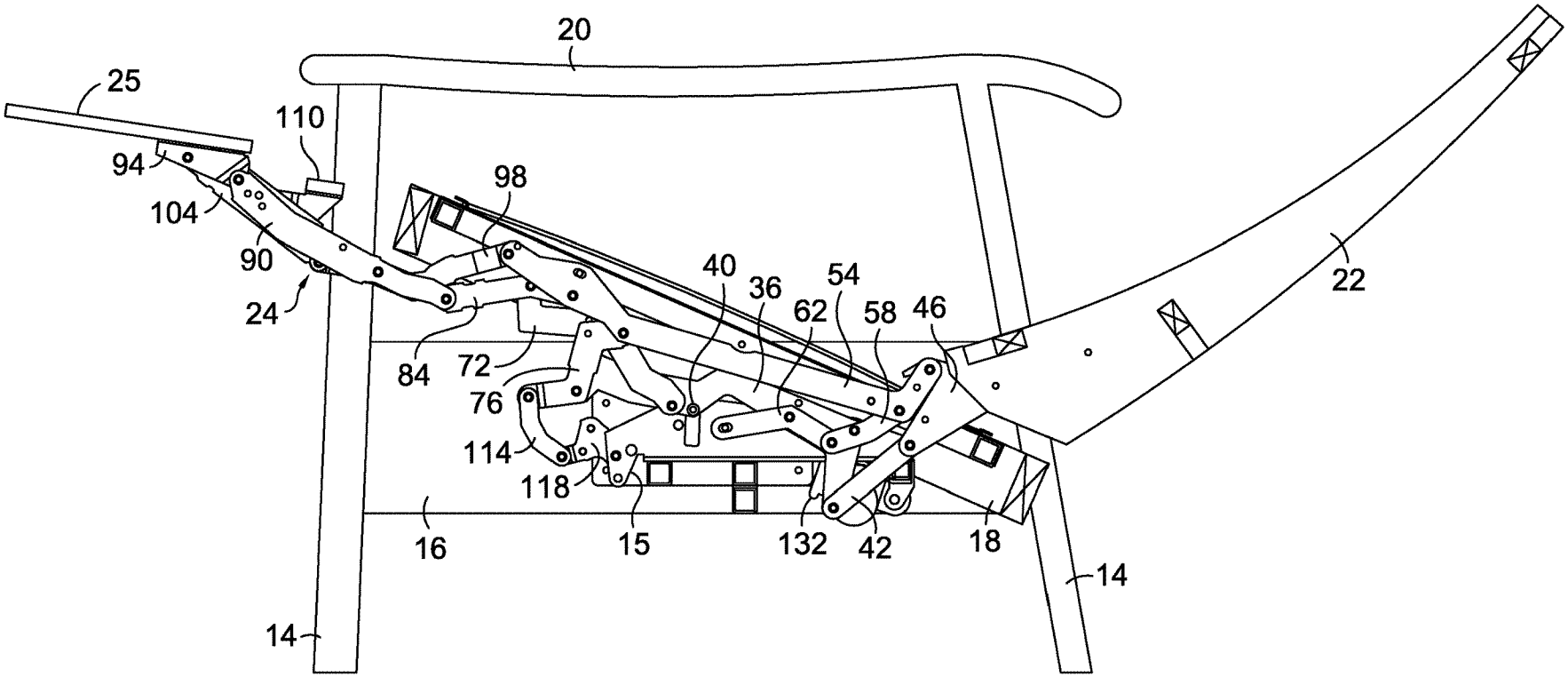
FIG. 3 is a view similar to FIG. 2, but showing the chair in the fully reclined position.

To move the mechanism 10, and the chair 12 from the TV position of FIG. 2 to the fully-reclined position of FIG. 3, the user can further activate the motor 132 to further retract the shaft of the motor 132. This motion pivots the recline tilt link 36 relative to the chassis link 26 about pivot point 38. The recline tilt link 36 is guided and restrained in this movement by rivet 40 in slot 34. As the recline tilt link 36 pivots, the rivet 40 moves from the bottom of the slot 34 to the top of the slot 34. As the recline tilt link 36 pivots about pivot point 38, the pivot point 44 is pulled forward to further recline the back link 46 (and the back 22).

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A seating unit moveable between closed, extended and fully reclined positions, the seating unit comprising;

two sides spaced from one another, wherein the two sides have a bottom edge spaced apart from a support surface on which the seating unit rests in use;

a seat extending between the two sides;

an extendable ottoman;

a chair back extending upwardly from a rearward edge of the seat;

a side plate adjacent each of the two sides;

at least one support tube extending between the side plates;

a linkage mechanism supported between the side plates and coupling at least the extendable ottoman and the chair back;

a motor coupled to the linkage mechanism to move the seating unit between the closed, extended and fully reclined positions, wherein the motor extends above the at least one support tube, such that the two sides substantially obscure the linkage mechanism and the motor from view; and wherein the at least one support tube including a downwardly extending central section, providing clearance for the motor above the at least one support tube.

2. The seating unit of claim 1, wherein, in the extended position, the linkage mechanism holds the extendable ottoman substantially parallel to the support surface on which the seating unit rests, and wherein as the motor moves the linkage mechanism from the extended to the closed position, the linkage mechanism moves the extendable ottoman through a position perpendicular to the support surface on which the seating unit rests to a position at least about forty-five degrees past perpendicular to the support surface on which the seating unit rests.

3. The seating unit of claim 2, wherein as the motor moves the linkage mechanism from the extended to the closed position, the linkage mechanism moves the extendable ottoman through a position perpendicular to the support surface on which the seating unit rests to a position at least about fifty-five degrees past perpendicular to the support surface on which the seating unit rests.

4. The seating unit of claim 3, wherein as the motor moves the linkage mechanism from the extended to the closed position, the linkage mechanism moves the extendable ottoman through a position perpendicular to the support surface on which the seating unit rests to a position at least about sixty-seven degrees past perpendicular to the support surface on which the seating unit rests.

5. The seating unit of claim 1, wherein the seat comprises a padded portion supported on a resilient support surface of the seating unit, and wherein the resilient support surface has a point of maximum deformation, and wherein at the point of maximum deformation, the motor is spaced from the resilient support surface by at least one-and-a-half inches.

6. The seating unit of claim 5, wherein at the point of maximum deformation, the motor is spaced from the resilient support surface by at least two inches.

7. The seating unit of claim 6, wherein at the point of maximum deformation, the motor is spaced from the resilient support surface by at least two-and-a-half inches.

* * * * *